US005297597A

United States Patent [19]

Herzog

[11] Patent Number: 5,297,597

[45] Date of Patent: Mar. 29, 1994

[54] CONTAINER FILLER INDEXING COUNTER

[76] Inventor: Kenneth J. Herzog, 200 Mill Rd., Riverhead, N.Y. 11901

[21] Appl. No.: 9,590

[22] Filed: Jan. 26, 1993

[51] Int. Cl.[5] ..... B65B 3/12

[52] U.S. Cl. ..... 141/157; 141/159; 141/178; 141/180; 141/84; 141/242

[58] Field of Search ..... 141/129, 155, 156, 157, 141/159, 160, 161, 163, 178, 179, 180, 246, 242, 84, 235, 237

[56] References Cited

U.S. PATENT DOCUMENTS

| | | | |
|---|---|---|---|
| 3,651,836 | 3/1972 | Johnson | 141/160 X |
| 3,911,976 | 10/1975 | Rosen | 141/84 |
| 4,073,322 | 2/1978 | Bennett | 141/169 |
| 4,359,075 | 11/1982 | Eberle et al. | 141/177 |
| 5,035,270 | 7/1991 | Herzog | 141/177 X |
| 5,168,905 | 12/1992 | Phallen | 141/129 X |

FOREIGN PATENT DOCUMENTS

| | | | |
|---|---|---|---|
| 2126363 | 12/1972 | Fed. Rep. of Germany | 141/155 |

*Primary Examiner*—Ernest G. Cusick

[57] ABSTRACT

A container filler indexing counter is provided for an automatic filling machine, which consists of a conveyor having a belt and guide rail for carrying a plurality of containers therealong. Two cylinders are spaced apart and adjustably mounted to the conveyor, in which the first cylinder is positioned as an incoming stop gate, while the second cylinder is positioned as an exit stop gate to form a filling area therebetween. Two fiber optic sensors are spaced apart and adjustably mounted to the guide rail of the conveyor, in which the first fiber optic sensor is positioned as a counter for the containers entering the filling area, while the second fiber optic sensor is positioned as a counter for the containers leaving the filling area. A device is for operating the two cylinders by count information received from the two fiber optic sensors, so that at least one container entering the filling area on the belt of the conveyor can be automatically filled by a filler mechanism and then removed therefrom on the belt of the conveyor.

2 Claims, 1 Drawing Sheet

CONTAINER FILLER INDEXING COUNTER

BACKGROUND OF THE INVENTION

The instant invention relates generally to automatic filling machines and more specifically it relates to a container filler indexing counter for an automatic filling machine, having a pair of fiber optic sensors that contain and count out containers at a filling area, so that the containers can be immediately filled and conveyed therefrom on a conveyor.

There are available various conventional automatic filling machines which do not provide the novel improvements of the invention herein disclosed.

SUMMARY OF THE INVENTION

A primary object of the present invention is to provide a container filler indexing counter for an automatic filling machine that will overcome the shortcomings of the prior art devices.

Another object is to provide a container filler indexing counter for an automatic filling machine that utilizes a mechanism having a fiber optic sensor to count in containers entering a filling area on a conveyor belt, so that a filler mechanism can be immediately activated to fill the containers.

An additional object is to provide a container filler indexing counter for an automatic filling machine that utilizes the mechanism having another fiber optic sensor to count out the containers leaving the filling area on the conveyor belt to complete the cycle and start again.

A further object is to provide a container filler indexing counter for an automatic filling machine that is simple and easy to use.

A still further object is to provide a container filler indexing counter for an automatic filling machine that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
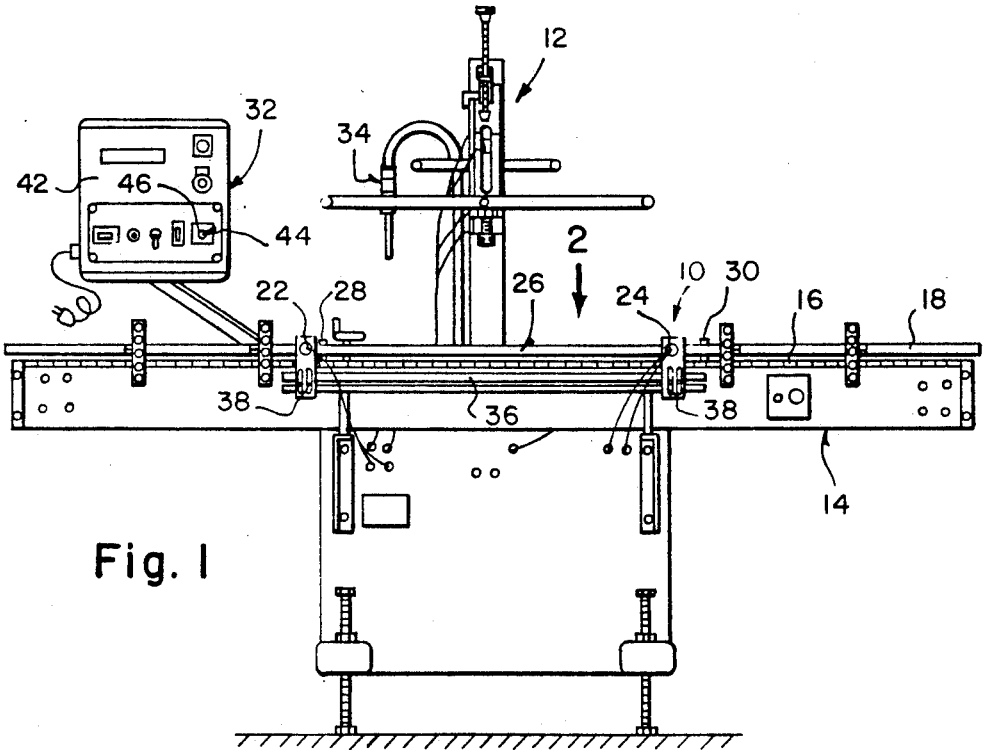
FIG. 1 is a front view of the instant invention installed in an automatic filling machine.
Figure 2:
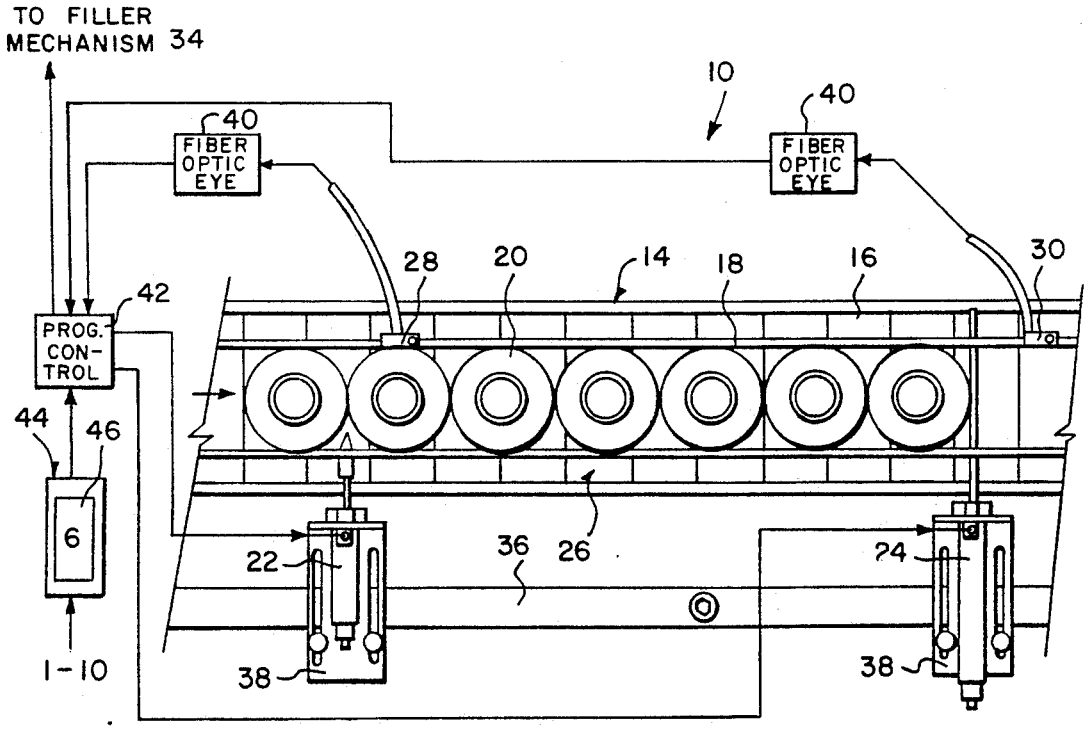
FIG. 2 is an enlarged top view taken in direction of arrow 2 with parts in a block diagram showing the structure of the instant invention.

Turning now descriptively to the drawings, in which similar reference characters denote similar elements throughout the several views, the Figures illustrate a container filler indexing counter 10 for an automatic filling machine 12 which consists of a conveyor 14 having a belt 16 and guide rail 18 for carrying a plurality of containers 20 therealong. Two cylinders 22 and 24 are spaced apart and adjustably mounted to the conveyor 14. The first cylinder 22 is positioned as an incoming stop gate, while the second cylinder 24 is positioned as an exit stop gate to form a filling area 26 therebetween. Two fiber optic sensors 28 and 30 are spaced apart and are adjustably mounted to the guide rail 18 of the conveyor 14. The first fiber optic sensor 28 is positioned as a counter for the containers 20 entering the filling area 26, while the second fiber optic sensor 30 is positioned as a counter for the containers 20 leaving the filling area 26. An operating device 3 is provided for operating the two cylinders 22 and 24 by count information received from the two fiber optic sensors 28 and 30, so that at least one container 20 entering the filling area 26 on the belt 16 of the conveyor 14 can be automatically filled by a filler mechanism 34 having a plurality of nozzles as in U.S. Pat. No. 5,035,270 and then removed therefrom on the belt 16 of the conveyor 14.

The two cylinders 22 and 24 are adjustably mounted to the conveyor 14 by a mounting rail 36 attached to a side of the conveyor 14 and a pair of mounting brackets 38, in which each mounting bracket 38 is adjustably mounted between one of the cylinders 22, 24 and the mounting rail 36.

The operating device referred to hereinabove includes a pair of fiber optic eyes 40, each connected to one of the fiber optic sensors 28, 30. A programmable control 42 is connected to the pair of fiber optic eyes 40, the pair of cylinders 22, 24 and the filler mechanism 34. An apparatus 44 is for entering into the programmable controller 42 the amount of containers 20 to be filled at the filling area 26.

The entering apparatus 44 is a counter unit 46 connected to the programmable controller 42 to provide data for the correct number of containers 20 to be filled at the filling area 26. At the start of a filling cycle, the programmable controller 42 will close the second cylinder 24 and open the first cylinder 22 to allow the proper amount of containers 20 to enter the filling area 26 and be counted by the first optic sensor 28. The first cylinder 22 will then close and the filling mechanism 34 activated to fill the containers 20. The second cylinder 24 will now open to release all of the filled containers 20 from the filling area 26 to be counted by the second optic sensor 30, in which the programmable controller 42 will start the filling cycle again.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A container filler indexing counter for an automatic filling machine comprising:

a) a filler mechanism and a conveyor having a belt and guide rail for carrying a plurality of containers therealong;

b) two cylinders spaced apart and adjustably mounted to said conveyor, in which said first cylinder is positioned as an incoming stop gate, while said second cylinder is positioned as an exit stop gate to form a filling area therebetween;

c) two fiber optic sensors, spaced apart and adjustably mounted to the guide rail of said conveyor, in which said first fiber optic sensor is positioned as a counter for the containers entering the filling area, while said second fiber optic sensor is positioned as a counter for the containers leaving the filling area;

d) means for operating said two cylinders by count information received from said two fiber optic sensors, so that at least one container entering the filling area on the belt of said conveyor can be automatically filed by said filler mechanism and then removed therefrom on the belt of said conveyor; wherein said two cylinders are adjustably mounted to said conveyor by a mounting rail attached to a side of said conveyor and a pair of mounting brackets, in which each said mounting bracket is adjustably mounted between one of said cylinders and said mounting rail; wherein said operating means includes:

e) a pair of fiber optic eyes, each connected to one of said fiber optic sensors;

f) a programmable controller connected to said pair of fiber optic eyes, said pair of cylinders and the filler mechanism; and g) means for entering into said programmable controller the amount of containers to be filled at the filling area.

2. A container filler indexing counter as recited in claim 1, wherein said entering means is a counter unit connected to said programmable controller to provide data for the correct number of containers to be filled at the filling area, so that at the start of a filling cycle, said programmable controller will close said second cylinder and open said first first cylinder to allow the proper amount of containers to enter the filling area and be counted by said first optic sensor, said first cylinder will then close and the filling mechanism activated to fill the containers, said second cylinder will now open to release all of the filled containers from the filling area to be counted by said second optic sensor in which said programmable controller will start the filling cycle again.

* * * * *